US008127494B2

(12) United States Patent
Kondash et al.

(10) Patent No.: US 8,127,494 B2
(45) Date of Patent: Mar. 6, 2012

(54) SELF ADJUSTING TRACK CHAIN ADJUSTMENT TROLLEY

(75) Inventors: Joseph D. Kondash, Wilkes-Barre, PA (US); Joseph L. Balay, Sugarloaf, PA (US)

(73) Assignee: Cornell Iron Works, Inc., Mountaintop, PA (US)

( * ) Notice: Subject to any disclaimer, the term of this patent is extended or adjusted under 35 U.S.C. 154(b) by 838 days.

(21) Appl. No.: 12/203,718

(22) Filed: Sep. 3, 2008

(65) Prior Publication Data

US 2010/0056311 A1 Mar. 4, 2010

(51) Int. Cl.
*E05D 15/26* (2006.01)

(52) U.S. Cl. ..... 49/324; 49/197; 49/199; 49/506

(58) Field of Classification Search ..... 49/197, 49/199, 324, 360; 474/101, 218, 253, 255; 160/188, 189, 199
See application file for complete search history.

(56) References Cited

U.S. PATENT DOCUMENTS

| | | | | | |
|---|---|---|---|---|---|
| 2,225,003 | A | * | 12/1940 | Gorman | 49/28 |
| 3,142,095 | A | * | 7/1964 | Sawyer | 49/366 |
| 3,343,858 | A | * | 9/1967 | Rice | 403/229 |
| 3,526,994 | A | * | 9/1970 | Delaney | 49/199 |
| 3,648,326 | A | | 3/1972 | Gaysowski | |
| 3,728,605 | A | | 4/1973 | Purtilo | |
| 4,133,364 | A | * | 1/1979 | Smart | 160/199 |
| 4,237,655 | A | * | 12/1980 | Yamao | 49/252 |
| 4,330,960 | A | * | 5/1982 | Hasemann et al. | 49/404 |
| 4,599,824 | A | | 7/1986 | Mitsuhashi et al. | |
| 5,222,403 | A | * | 6/1993 | Angelini et al. | 74/89.21 |
| 5,297,782 | A | * | 3/1994 | Dombrowski et al. | 267/177 |
| 5,343,923 | A | | 9/1994 | Keller | |
| 5,499,671 | A | * | 3/1996 | Owens | 160/199 |
| 5,509,572 | A | | 4/1996 | Curtis | |
| 5,819,878 | A | * | 10/1998 | Barrett et al. | 187/324 |
| 5,860,365 | A | * | 1/1999 | Lhotak | 104/172.5 |
| 6,098,695 | A | * | 8/2000 | Schwingle | 160/199 |
| 6,193,621 | B1 | * | 2/2001 | McClosky | 474/101 |
| 6,269,963 | B1 | | 8/2001 | Hall | |
| 6,470,952 | B1 | * | 10/2002 | Cline et al. | 160/188 |
| 6,626,267 | B2 | | 9/2003 | Beus et al. | |
| 6,715,530 | B2 | * | 4/2004 | Goldsmith et al. | 160/199 |
| 6,883,579 | B2 | | 4/2005 | Olmsted | |
| 6,988,760 | B2 | | 1/2006 | Rasmussen | |
| 7,121,612 | B2 | | 10/2006 | Rasmussen | |
| 7,121,613 | B1 | | 10/2006 | Rasmussen | |
| 7,143,547 | B2 | | 12/2006 | Liles, Jr. | |

(Continued)

FOREIGN PATENT DOCUMENTS

GB 2108246 5/1983

*Primary Examiner* — Katherine W Mitchell
*Assistant Examiner* — Justin Rephann
(74) *Attorney, Agent, or Firm* — Mitchell A. Smolow

(57) ABSTRACT

A self adjusting chain adjustment trolley comprising a stabilizer bar trolley assembly affixed to a chain tensioner assembly for translationally engaging a track, the stabilizer bar trolley assembly having a chain second end attachment point for engaging a chain second end; a sliding door attachment point affixed to the chain tensioner assembly for engaging a sliding door; and a track engagement assembly affixed to the chain tensioner assembly for translationally engaging the track. The chain tensioner assembly comprises a movable chain first end attachment point for engaging a chain first end and a force applicator attached thereto, such that the force applicator applies a predetermined amount of force to the movable chain first end attachment point to create a predetermined tension on the chain.

25 Claims, 6 Drawing Sheets

U.S. PATENT DOCUMENTS

| | | | | |
|---|---|---|---|---|
| 7,198,320 | B2 | 4/2007 | Rasmussen | |
| 7,220,198 | B2 * | 5/2007 | Iida | 474/253 |
| 2002/0157904 | A1 | 10/2002 | Brus et al. | |
| 2007/0272370 | A1 * | 11/2007 | Knutson et al. | 160/199 |
| 2008/0105387 | A1 * | 5/2008 | Coleman et al. | 160/194 |
| 2008/0169069 | A1 * | 7/2008 | Coleman et al. | 160/199 |

* cited by examiner

SELF ADJUSTING TRACK CHAIN ADJUSTMENT TROLLEY

FIELD OF THE INVENTION

This invention relates generally to sliding doors and in particular, to a self adjusting track chain adjustment trolley used with side folding accordion partitions.

BACKGROUND OF THE INVENTION

Side folding accordion partitions are used to provide space separation, often with the additional goal of providing one or more of security separation, sound control, and prevention of the spread of fire and smoke.

Panels which form the partition are attached to ball bearing rollers which ride within a mounted overhead track. A lead panel is attached to a lead post which in turn is attached to a trolley having ball bearing rollers which also rides within the overhead track. A powered looped chain is attached to the trolley, thereby providing the mechanical action required to open and close the partition.

Through usage and/or ambient temperature changes, the chain can expand. In order to effectuate smooth movement of the partition, the chain must be kept at a predetermined tension. Various designs have been utilized to provide the required chain tension. Known designs require periodic technician intervention to maintain proper chain tension. Once such design uses a threaded rod to engage a nut welded to the bottom of a chain attachment bracket. The rod must be periodically manually further threadably engaged to maintain proper chain tension as the chain stretches with use and/or environmental conditions.

Known designs do not allow for self-adjustment of the chain tension. Rather, as the chain expands from use or due to environmental conditions with concomitant decrease in chain tension, technician intervention is required to re-tension the chain.

Accordingly, there is still a continuing need for improved chain tensioning designs. The present invention fulfills this need by presenting a novel self adjusting chain tensioning trolley and further provides related advantages.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

Figure 1:
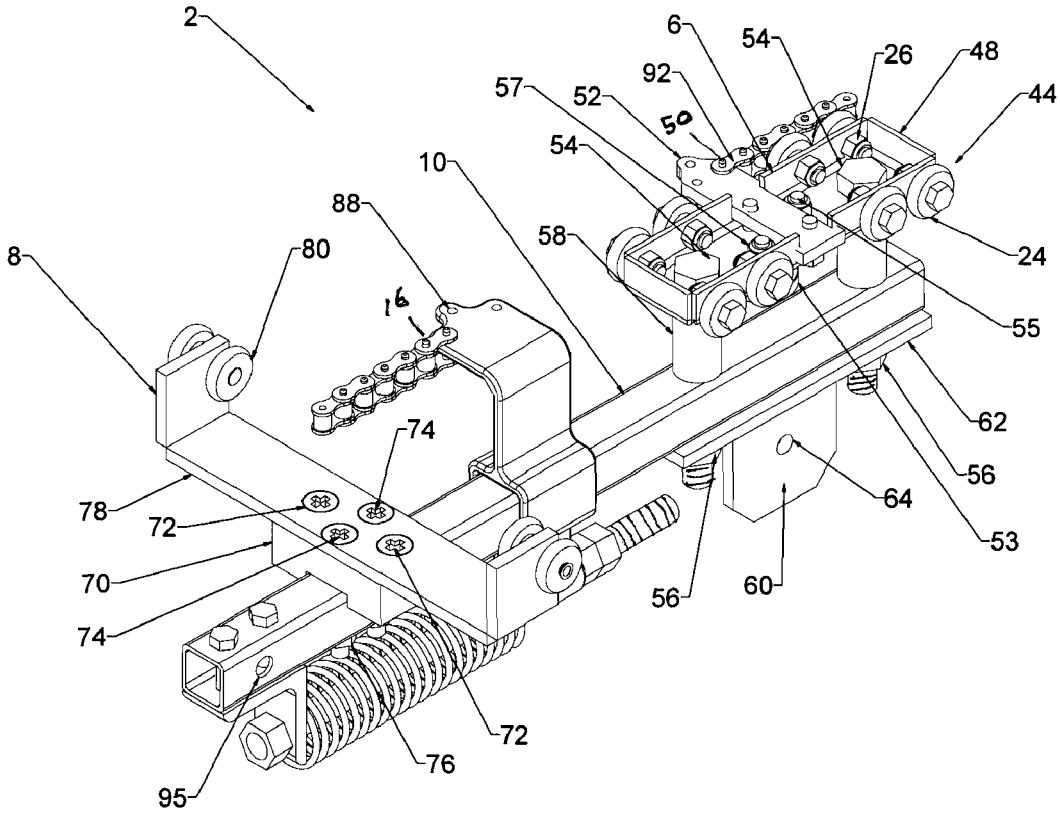
FIG. 1 is a perspective view of the chain adjustment trolley.
Figure 2:
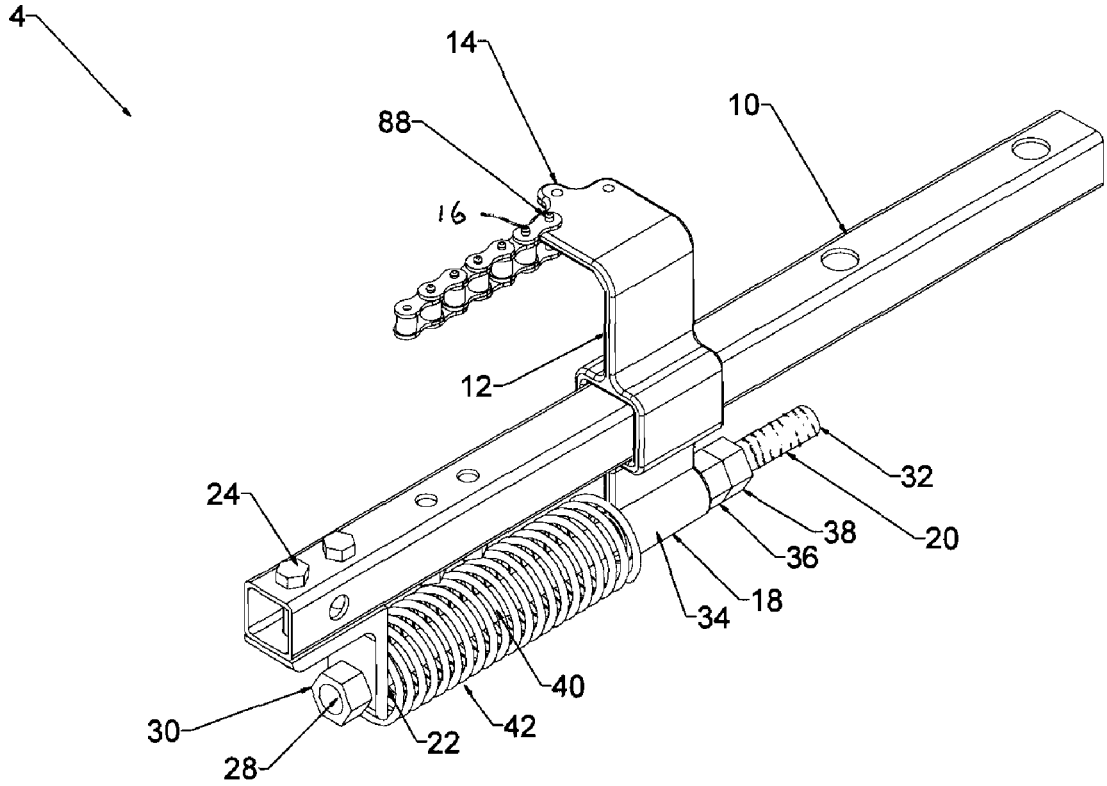
FIG. 2 is a perspective view of the chain tensioner assembly.

Turning now to FIGS. 1 and 2, track chain adjustment trolley 2 comprises chain tensioner assembly 4, stabilizer bar trolley assembly 6 and track engagement assembly 8.

Chain tensioner assembly 4 comprises tube 10, preferably a hollow bar, upon which spring bracket 12 is slidably engaged. Spring bracket 12 has superior portion 14 for receiving chain first end 16 and inferior portion 18 for receiving spring tensioning rod 20 as described in detail below. Superior portion 14 is dimensioned to travel unrestricted within track inner channel 68 (FIG. 5), described in detail below.

Rod bracket 22 is affixed to tube 10 for example with one or more bolt 24 and nut 26. Rod first threaded end 28 passes through a rod bracket orifice (not shown) to receive nut 30. Rod second threaded end 32 is slidably engaged by channel 34 fabricated into spring bracket inferior portion 18 thereafter receiving a restrictor, for example, nut 36 and jamb nut 38. Rod 40 passes through spring 42 to maintain spring 42 engagement between rod bracket 22 and spring bracket inferior portion 18.

Figure 5:
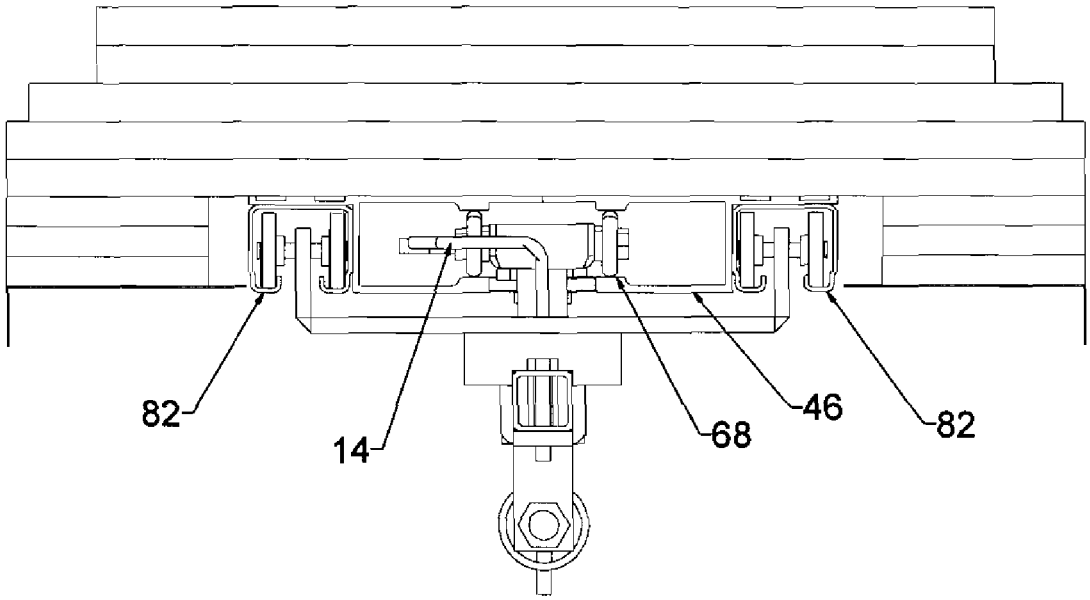
FIG. 5 is a cross sectional view of the chain adjustment trolley engaged in a track.

Stabilizer bar trolley assembly 6 comprises a plurality of rollers 44, preferably ball bearing rollers, which engage chain guide 46 at inner channel 68 as shown in FIG. 5. Chain guide 46 is mounted to a door opening (not shown) in conventional manner. Rollers 44 are mounted to frame 48 using, for example, bolt 24 and nut 26. A portion of frame 48 is fabricated to receive chain second end 50. In a preferred embodiment, chain second end receiving plate 52 is affixed, for example, crimped, bolted or spot welded, to frame 48 to receive chain second end 50.

Figure 3:
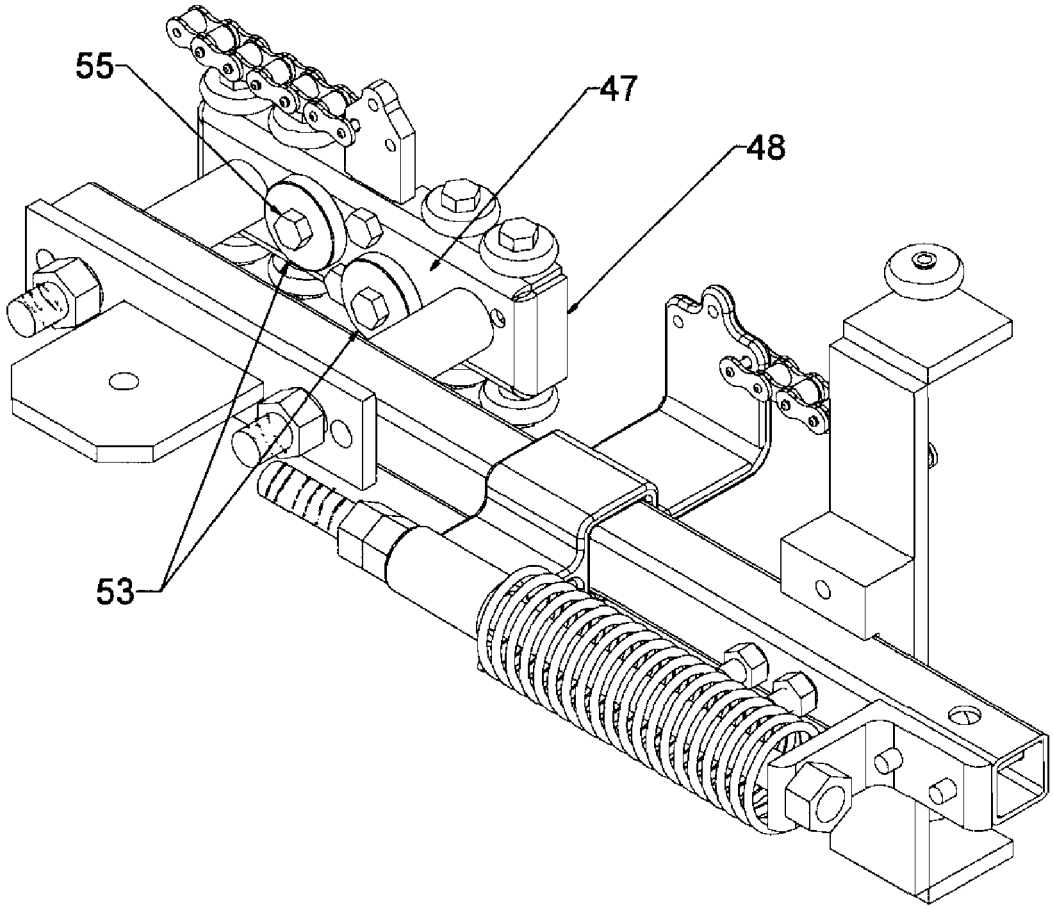
FIG. 3 is a perspective view of the underside of the chain adjustment trolley.

Bearings 53 (FIG. 3) are mounted to underside 47 of frame 48 using bolt 55 and nut 57. Bearings 53 are of sufficient diameter so as to extend beyond side of frame 44 an effective distance to engage side walls of track inner channel 68, thereby helping to center trolley 2 within chain guide 46.

Figure 4:
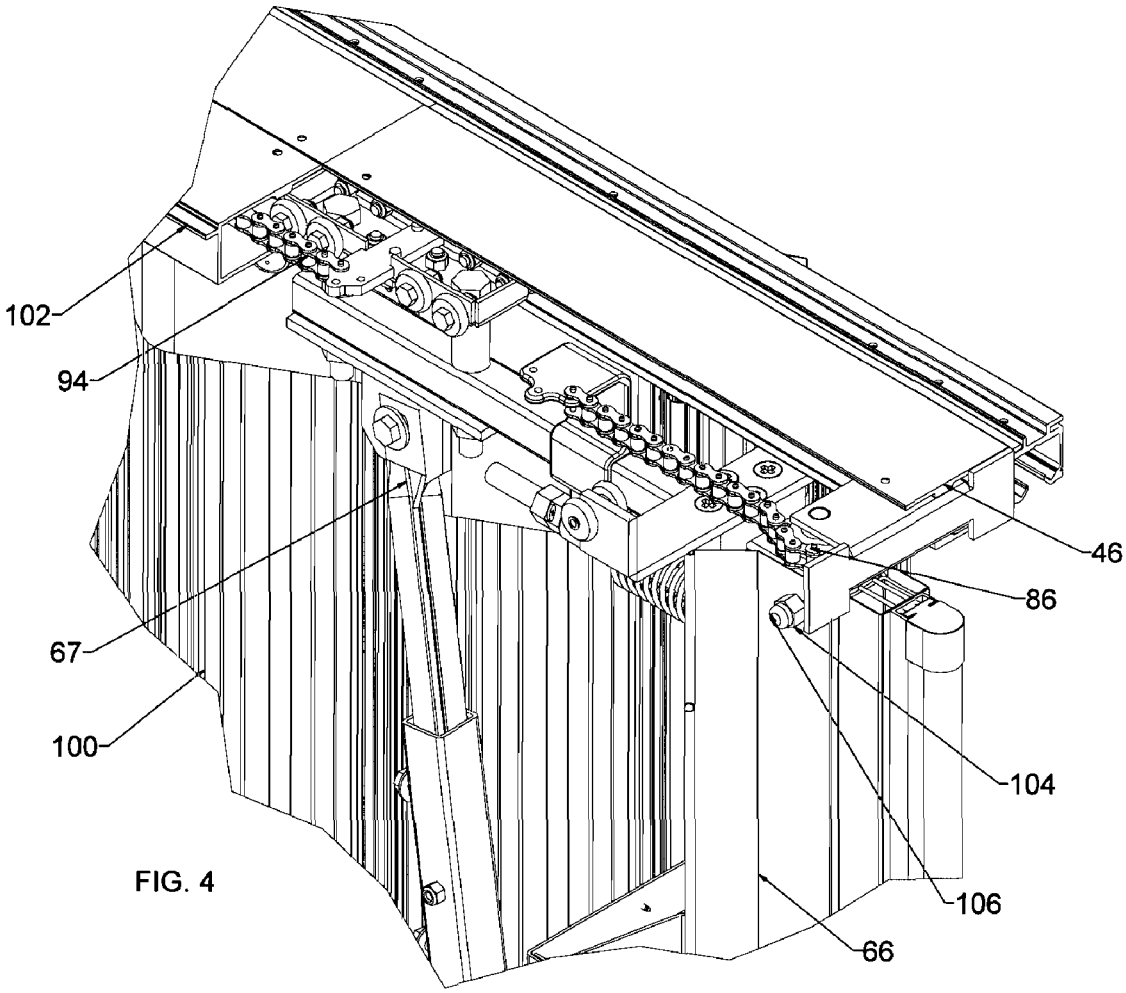
FIG. 4 is a perspective view of a partition/chain/trolley arrangement.

Stabilizer bar trolley assembly 6 is mounted to tube 10 with bolts 54 and nut 56. Spacers 58 provide a predetermined amount of spacing from tube 10. Primary attachment point, for example, orifice 95, receives lead post 66 (FIG. 4) described in greater detail below. An optional secondary attachment point, for example, tab 60 is fabricated onto plate 62 by conventional means, for example, welding, and contains orifice 64 for receiving lead post secondary attachment member 67 (FIG. 4). Plate 62 is mounted to underside of tube 10 using bolt 54 and nut 56.

Track engagement assembly 8 is mounted to spacer 70 with screws 72 and recessed bolts 74 and nuts 76. Recessed bolts 74 pass through spacer 70 and tube 10, thereby fixing spacer 70 and in turn, track engagement assembly 8, to tube 10. Recessed bolts 74 are of predetermined length so as not to interfere with spring 42. Track engagement assembly 8 has opposing wings 78 having rollers 80, preferably ball bearing rollers, rotably affixed thereto, positioned to engage track outer channel 82 as shown in FIG. 5. While not required to be level, in a preferred embodiment, spacers 58 and spacer 70 are of predetermined height such that when rollers 44, 80 engage track inner and outer channels 68, 82, tube 10 remains level.

Figure 6:
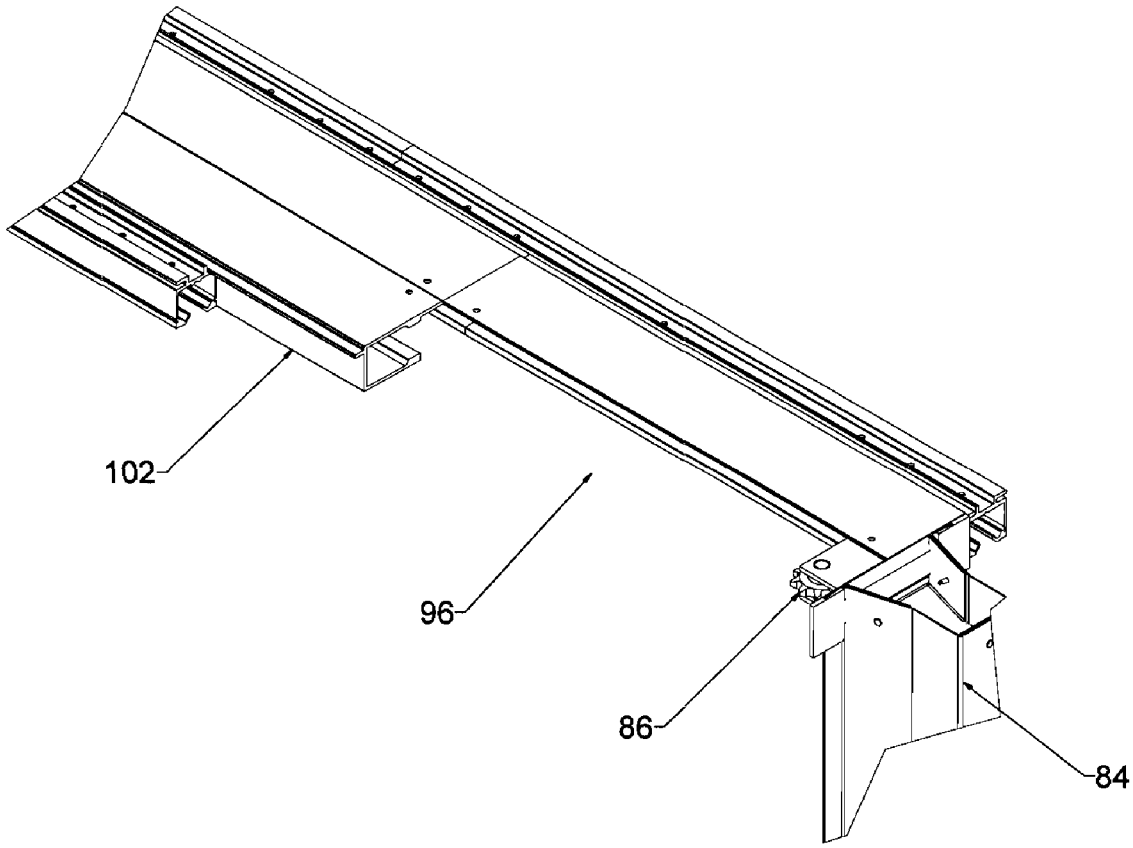
FIG. 6 is a perspective view showing a removed load section.

After chain guide 46 (FIG. 5) and striker 84 (FIG. 6) are mounted to door opening (not shown) in conventional manner, utilizing a known removed track and chain guide load section 96 (FIG. 6), chain adjustment trolley 2 is translationally engaged into chain guide 46. The known removed load section 96 also allows for ease of removal of chain adjustment trolley 2 as necessary for servicing. Load section technology is well known and will not be described in further detail herein. Striker 84 is mounted to door opening (not shown) using known mounting hardware. Although "in-line" engagement of rollers 44, 80 into a single track is contemplated by the present invention, in a preferred use, rollers 44, 80 are engaged into track inner and outer channels 68, 82, respectively, thereby translationally engaging chain adjustment trolley 2 into chain guide 46.

Referring to FIG. 4, chain pulley 86 is mounted within chain guide 46 in conventional manner. Partition sections are translationally mounted to track 102 in conventional manner. Partition section 100 is mounted to lead post 66. Lead post 66 is mounted to trolley 2 via nut 104 and bolt 106 passing through orifice 95 (FIG. 1).

Spring 42 is fully compressed by tightening nut 36 and jamb nut 38. Compression is achieved as spring bracket 12 slides along tube 10 as nut 36 and jamb nut 38 continue to further engage rod second threaded end 32. Once spring 42 is compressed, chain first end 16 is attached to spring bracket superior portion 14 for example, by using a master link attached to orifice 88. Chain is thereafter looped around chain pulley 86 and conventional power sprocket (not shown) remotely located from chain pulley 86 in conventional manner with chain second end 50 terminating in conventional attachment to stabilizer bar trolley assembly receiver plate 52 for example, by using a master link attached to orifice 92.

Chain 94 is of predetermined length to provide a predetermined initial tension. Once chain 94 is fully engaged, jamb nut 38 and nut 36 are loosed, thereby permitting spring 42 to apply a predetermined amount of force upon chain 94 to maintain a predetermined operating tension. It should be apparent that the predetermined amount of force spring 42 provides can be varied by utilizing predetermined spring coil thickness and/or spring material.

In this manner, the novel force applicator arrangement of the present invention maintains continuous predetermined chain operating tension regardless of chain stretching; all without technician intervention. The arrangement also serves as a shock absorber, in that as lead post 66 encounters an obstruction or is pushed upon, spring 42 compresses, thereby helping to prevent chain 94 from jumping on the sprocket.

Although the present invention has been described in connection with specific examples and embodiments, those skilled in the art will recognize that the present invention is capable of other variations and modifications within its scope. For example, while the preferred embodiment utilized two distinct sets of rollers (stabilizer bar trolley assembly 6 and track engagement assembly 8), a single translational assembly (for example, only stabilizer bar trolley assembly 6) is also contemplated.

These examples and embodiments are intended as typical of, rather than in any way limiting on, the scope of the present invention as presented in the appended claims.

What is claimed is:

1. A self-adjusting chain adjustment trolley comprising:

a translational assembly affixed to a chain tensioner assembly for translationally engaging a track, the translational assembly having a chain second end attachment point for engaging a chain second end; and a door attachment point affixed to the chain tensioner assembly for engaging a sliding door;

wherein the chain tensioner assembly comprises a movable chain first end attachment point for engaging a chain first end and a force applicator attached thereto; a bar slidably receiving the movable chain first end attachment point; a bracket attached to the bar; and a rod having a first end fixedly attached to the bracket and a second end slidably engaged by the movable chain first end attachment point; the force applicator positioned between the bracket and the movable chain first end attachment point, such that the force applicator applies a predetermined amount of force to the movable chain first end attachment point to create a predetermined tension on the chain.

2. The chain adjustment trolley of claim 1 wherein the force applicator is a spring.

3. The chain adjustment trolley of claim 1 further comprising a restrictor attached to the rod second end to adjustably restrict slidability of the movable chain first end attachment point and a first and second bearing mounted to the underside of the translational assembly, the bearings of effective diameter so as to extend beyond a side of the translational assembly an effective distance to engage a side wall of the track.

4. A self-adjusting chain adjustment trolley comprising:

a stabilizer bar trolley assembly affixed to a chain tensioner assembly for translationally engaging a track, the stabilizer bar trolley assembly having a chain second end attachment point for engaging a chain second end;

a sliding door attachment point affixed to the chain tensioner assembly for engaging a sliding door;

a track engagement assembly affixed to the chain tensioner assembly for translationally engaging the track;

wherein the chain tensioner assembly comprises a movable chain first end attachment point for engaging a chain first end and a force applicator attached thereto; a bar slidably receiving the movable chain first end attachment point; a bracket attached to the bar; and a rod having a first end fixedly attached to the bracket and a second end slidably engaged by the movable chain first end attachment point; the force applicator positioned between the bracket and the movable chain first end attachment point, such that the force applicator applies a predetermined amount of force to the movable chain first end attachment point to create a predetermined tension on the chain.

5. The chain adjustment trolley of claim 4 wherein the stabilizer bar trolley assembly and the track engagement assembly further comprise rotatably attached rollers to provide the translational engagement.

6. The chain adjustment trolley of claim 4 wherein the stabilizer bar trolley assembly and the track engagement assembly are each spaced from the chain tensioner assembly a predetermined distance so as to keep the chain tensioner assembly level upon chain adjustment trolley engagement with the track.

7. The chain adjustment trolley of claim 4 wherein the force applicator is a spring.

8. The chain adjustment trolley of claim 4 further comprising a restrictor attached to the rod second end to adjustably restrict slidability of the movable chain first end attachment point and a first and second bearing mounted to the underside of the stabilizer bar trolley assembly, the bearings of effective diameter so as to extend beyond a side of the stabilizer bar trolley assembly an effective distance to engage a side wall of the track.

9. The chain adjustment trolley of claim 4 wherein the stabilizer bar trolley assembly and the track engagement assembly are not in-line.

10. A sliding door apparatus comprising:

a track for mounting to a door opening;

a door slidably attached to the track;

a chain pulley for mounting to the door opening;

a self-adjusting chain adjustment trolley adapted for translational movement within the track and attachment to the door; and a powered chain operatively connecting the pulley and self-adjusting chain adjustment trolley;

wherein the self-adjusting chain adjustment trolley comprises a translational assembly affixed to a chain tensioner assembly for translationally engaging a track, the translational assembly having a chain second end attachment point for engaging a chain second end; and a door attachment point affixed to the chain tensioner assembly for engaging a sliding door;

wherein the chain tensioner assembly comprises a movable chain first end attachment point for engaging a chain first end and a force applicator attached thereto, such that the force applicator applies a predetermined amount of force to the movable chain first end attachment point to create a predetermined tension on the chain; and the translational assembly comprises a stabilizer bar trolley assembly affixed to the chain tensioner assembly to translationally engage the track, the stabilizer bar trolley assembly having the chain second end attachment point for engaging the chain second end; and a track engagement assembly affixed to the chain tensioner assembly for translationally engaging the track.

11. The sliding door apparatus of claim 10 wherein the stabilizer bar trolley assembly and the track engagement assembly further comprise rotatably attached rollers to provide the translational engagement.

12. The sliding door apparatus of claim 10 wherein the stabilizer bar trolley assembly and the track engagement assembly are each spaced from the chain tensioner assembly a predetermined distance so as to keep the chain tensioner assembly level upon chain adjustment trolley engagement with the track.

13. The sliding door apparatus of claim 10 wherein the chain tensioner assembly comprises a bar slidably receiving the movable chain first end attachment point; a bracket attached to the bar; and a rod having a first end fixedly attached to the bracket and a second end slidably engaged by the movable chain first end attachment point; the force applicator positioned between the bracket and the movable chain first end attachment point.

14. The sliding door apparatus of claim 13 wherein the force applicator is a spring.

15. The sliding door apparatus of claim 13 further comprising a restrictor attached to the rod second end to adjustably restrict slidability of the movable chain first end attachment point and a first and second bearing mounted to the underside of the stabilizer bar trolley assembly, the bearings of effective diameter so as to extend beyond a side of the stabilizer bar trolley assembly an effective distance to engage a side wall of the track.

16. The sliding door apparatus of claim 10 wherein the stabilizer bar trolley assembly engages a track inner channel and the track engagement assembly engages a track outer channel.

17. The sliding door apparatus of claim 16 further comprising a first and second bearing mounted to the underside of the stabilizer bar trolley assembly, the bearings of effective diameter so as to extend beyond a side of the stabilizer bar trolley assembly an effective distance to engage a side wall of the side track inner channel.

18. The sliding door apparatus of claim 10 wherein the stabilizer bar trolley assembly and the track engagement assembly engages the track in-line.

19. A method for self-tensioning a chain used to operate a sliding door slidably mounted to a track comprising the steps of:

a. installing a self-adjusting chain adjustment trolley within the track, wherein the chain adjustment trolley comprises a translational assembly affixed to a chain tensioner assembly for translationally engaging a track, the translational assembly having a chain second end attachment point for engaging a chain second end; and a door attachment point affixed to the chain tensioner assembly for engaging a sliding door;

wherein the chain tensioner assembly comprises a movable chain first end attachment point for engaging a chain first end and a force applicator attached thereto, such that the force applicator applies a predetermined amount of force to the movable chain first end attachment point to create a predetermined tension on the chain; and the translational assembly comprises a stabilizer bar trolley assembly affixed to the chain tensioner assembly to translationally engage the track, the stabilizer bar trolley assembly having the chain second end attachment point for engaging the chain second end; and a track engagement assembly affixed to the chain tensioner assembly for translationally engaging the track;

b. attaching the door to the sliding door attachment point;

c. attaching the chain second end to the chain second end attachment point;

d. applying to the movable chain first end attachment point a second force which is opposite in direction to and greater than the predetermined amount of force;

e. attaching the chain first end to the movable chain first end attachment point; and f. removing the second force.

20. The method of claim 19 wherein the stabilizer bar trolley assembly and the track engagement assembly further comprise rotatably attached rollers to provide the translational engagement.

21. The method of claim 19 wherein the stabilizer bar trolley assembly and the track engagement assembly are each spaced from the chain tensioner assembly a predetermined distance so as to keep the chain tensioner assembly level upon chain adjustment trolley engagement with the track.

22. The method of claim 19 wherein the chain tensioner assembly comprises a bar slidably receiving the movable chain first end attachment point; a bracket attached to the bar; and a rod having a first end fixedly attached to the bracket and a second end slidably engaged by the movable chain first end attachment point; the force applicator positioned between the bracket and the movable chain first end attachment point.

23. The method of claim 22 wherein the force applicator is a spring.

24. The method of claim 22 further comprising a restrictor attached to the rod second end to adjustably restrict slidability of the movable chain first end attachment point and a first and second bearing mounted to the underside of the stabilizer bar trolley assembly, the bearings of effective diameter so as to extend beyond a side of the stabilizer bar trolley assembly an effective distance to engage a side wall of the track.

25. The method of claim 19 wherein the stabilizer bar trolley assembly and the track engagement assembly are not in-line.

* * * * *